US009831538B2

(12) United States Patent
Sheta et al.

(10) Patent No.: US 9,831,538 B2
(45) Date of Patent: Nov. 28, 2017

(54) TUNABLE FILTER COMPRISING A MICROSTRIP PATCH HAVING SYMMETRICAL SLOTS, ASYMMETRICAL FEED LINES AND A PLURALITY OF DIODES

(71) Applicant: King Saud University, Riyadh (SA)

(72) Inventors: Abdel Fattah Ahmed Sheta, Riyadh (SA); Majeed Abdulrahman S. Alkanhal, Riyadh (SA)

(73) Assignee: King Saud University, Riyadh (SA)

( * ) Notice: Subject to any disclaimer, the term of this patent is extended or adjusted under 35 U.S.C. 154(b) by 0 days.

(21) Appl. No.: 14/439,401

(22) PCT Filed: Oct. 31, 2012

(86) PCT No.: PCT/US2012/062742
§ 371 (c)(1),
(2) Date: Apr. 29, 2015

(87) PCT Pub. No.: WO2014/070159
PCT Pub. Date: May 8, 2014

(65) Prior Publication Data

US 2015/0303542 A1 Oct. 22, 2015

(51) Int. Cl.
*H01P 1/203* (2006.01)
*H01P 7/08* (2006.01)
*H01P 1/20* (2006.01)

(52) U.S. Cl.
CPC ..... *H01P 1/20381* (2013.01); *H01P 1/2039* (2013.01); *H01P 1/20354* (2013.01); *H01P 7/082* (2013.01); *H01P 7/088* (2013.01); *H01P 1/20* (2013.01)

(58) Field of Classification Search
CPC .... H01P 1/20354; H01P 1/20381; H01P 7/08; H01P 7/088
USPC ..... 333/205
See application file for complete search history.

(56) References Cited

U.S. PATENT DOCUMENTS 5,805,034 A 9/1998 Evans et al.
6,563,404 B2 * 5/2003 Fiedziuszko et al. ..... H01P 1/20381 333/204
2004/0209581 A1 10/2004 Mizoguchi et al.
2012/0235772 A1 9/2012 Sheta et al.

OTHER PUBLICATIONS

Ariana Serrano et al; "A Tunable Bandpass Filter with Varactors"; Microwave Syposium Digest; pp. 1752 to 1755; IEEE MTT-S International; published May 23, 2010.*

(Continued)

*Primary Examiner* — Benny Lee
(74) *Attorney, Agent, or Firm* — Hauptman Ham, LLP

(57) ABSTRACT

The present disclosure introduces wide tunable band filters. In one embodiment, a wide tunable band filter apparatus is described. The filter apparatus may include a microstrip patch having a plurality of symmetrical slots etched into the microstrip patch. A plurality of diodes may be coupled to the microstrip patch. Furthermore, two asymmetrical feed lines may be connected to the microstrip patch. Other embodiments are also described.

20 Claims, 5 Drawing Sheets

(56) References Cited

OTHER PUBLICATIONS

Rehman, Sajja Ur, et al., "Compact MEMS Based Tunable Bandstop Microstrip Filter Using Defected Ground Structure (DGS)", Progress in Electromagnetics Research Symposium Abstracts, KL, Malaysia, Mar. 27-30, 2012, pp. 599.
Fok, Si-Weng, et al., "A Novel Microstrip Sqare-Loop Dual-Mode Bandpass Filter with Simultaneous Size Reduction and Spurious Response Suppression", May 2006, IEEE Transactions on Microwave Theory and Techniques, vol. 54, No. 5, pp. 2033-2041.
Mutairi, Mohammed R., et al., "A Novel Reconfigurable Dual-Mode Microstrip Meander Loop Filter", Proceedings of the 38th European Microwave Conference, Oct. 2008.
International Search Report dated Apr. 26, 2013 for International Patent Application No. PCT/US2012/062742, 3 pp.

* cited by examiner

TUNABLE FILTER COMPRISING A MICROSTRIP PATCH HAVING SYMMETRICAL SLOTS, ASYMMETRICAL FEED LINES AND A PLURALITY OF DIODES

TECHNICAL FIELD

The present disclosure relates generally to frequency filtering, and more particularly, to wide tunable band filters.

BACKGROUND

Wide tunable band filters are used in many applications, such as communication systems and radar systems. Specific applications include RF (radio frequency) and microwave transmitters and receivers, satellite communication systems, communication relays and various measurement systems. Wide tunable band filters are used to pass signals having specific frequencies with minimum insertion loss while rejecting other signals outside the specified frequencies.

The growing use of mobile devices and wireless communication systems has increased the demand for communication components, including wide tunable band filters. Existing wide band filters typically include resonators that have specific resonance frequencies. To perform certain filter characteristics (e.g., filter performance) using single mode resonators, multiple resonators are necessary. Thus, in systems requiring high order filters, the use of multiple single mode resonators increases the complexity of the design as well as the space occupied by the multiple resonator filters.

SUMMARY OF THE INVENTION

The present disclosure introduces wide tunable band filters. In one embodiment, a filter apparatus is described. The filter apparatus may include a microstrip patch having a plurality of symmetrical slots etched into the microstrip patch. A plurality of diodes may be coupled to the microstrip patch. Furthermore, two asymmetrical feed lines may be connected to the microstrip patch. Other embodiments are also described.

This summary is provided to introduce a selection of concepts in a simplified form that are further described below in the detailed description. This summary is not intended to identify key features or essential features of the claimed subject matter, nor is it intended to be used to limit the scope of the claimed subject matter.

BRIEF DESCRIPTION OF THE DRAWINGS

Various embodiments will now be described in detail with reference to the accompanying drawings.

DETAILED DESCRIPTION OF THE INVENTION

The following detailed description is divided into five sections. A first section provides a brief overview of wide tunable band filter apparatuses. A second section presents exemplary embodiments of wide tunable band filter apparatuses. The third section details exemplary methods of tunable band frequency filtering. Furthermore, the fourth section describes example implementations. Lastly, the final section presents the claims.

Overview

The wide tunable band filter apparatuses described herein include a microstrip patch resonator that is capable of operating in at least two different modes ("dual-mode"). By providing multiple modes of operation, this singlewide band filter is able to perform the function of a filter based on a plurality of single-mode resonators with a significant reduction in size of the filter device. The dual-mode capability of the wide tunable band filter apparatuses disclosed herein might be a filter constructed from a single dual-mode resonator (meaning the dual-mode filter is the equivalent of two coupled single-mode resonators). Alternatively, the wide tunable band filter may be constructed from two dual-mode resonators (meaning the dual-mode filter is the equivalent of four-single mode resonators).

The wide tunable band filters described herein are useful in a variety of applications such as radio frequency ("RF") and microwave communications as well as RF and microwave synthesizer modules contained in instruments and wireless devices. Specific applications include satellite communications, wireless base stations, radars, microwave relays, and electronic measurement systems.

Particular wide band filters discussed herein show various configurations, sizes, and location of slots, diodes, and feed lines. However, the present disclosure is capable of being implemented in a variety of different configurations with microstrip patches, slots, diodes, and feed lines of different shapes, sizes, and locations.

Wide Band Filter Apparatuses

Figure 1:
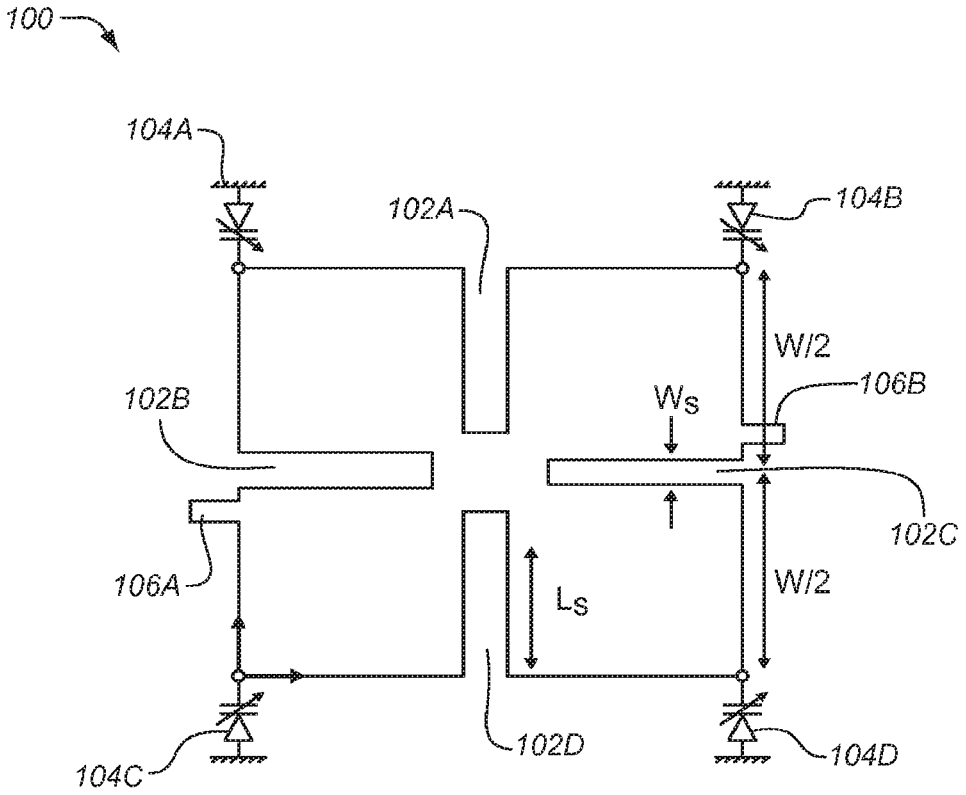
FIG. 1 is an exemplary view of a wide tunable band filter apparatus, according to an example embodiment.

FIG. 1 is an exemplary view of a filter apparatus, according to an example embodiment. The filter apparatus comprises a microstrip patch having a plurality of etched slots of length Ls and width Ws, a plurality of diodes coupled to the microstrip patch, and two asymmetrical feed lines connected to the microstrip patch. The filter apparatus may include a microstrip patch 100 having a plurality of symmetrical slots (102A, 103B, 102C, 102D) etched into the microstrip patch 100. In this implementation, the symmetrical slots 102A, 103B, 102C, 102D are spaced ½ of the width (W/2) of the square microstrip patch 100. The microstrip patch 100 may be fabricated out of any conductive material and use print circuit board technology to convey frequency signals. In one embodiment, the microstrip patch 100 may be a dual-mode microstrip patch capable of operating in both degenerate and higher order frequency modes. Degenerate frequency modes do not split and maintain the same resonant frequency. Higher order modes typically operate at higher frequency than the degenerate modes.

In an exemplary embodiment, the microstrip patch 100 may operate in a first higher order mode. A first higher order mode frequency may be reduced by the symmetrical slots 102A, 102B, 102C, 102D etched in the microstrip patch 100 and is usually greater than the resonance frequency of the degenerate modes. In an alternative embodiment, the microstrip patch 100 may operate in non-degenerate modes, meaning the singular microstrip patch 100 acts as multiple coupled resonators during operation of the filter. Frequencies may be determined based on the size of the microstrip patch 100 and the dimension of the etched symmetrical slots 102A, 102B, 102C, 102D.

The symmetrical slots 102A, 102B, 102C, 102D etched into the microstrip patch 100 may be used to control frequency band width throughout the microstrip patch 100. In an exemplary embodiment, the microstrip patch 100 may be in the shape of a square. In one embodiment, the plurality of symmetrical slots 102A, 102B, 102C, 102D may be rectangular in shape. In another exemplary embodiment, each of the plurality of symmetrical slots may be in the design of a cross. An exemplary embodiment of the microstrip patch 100 may have four symmetrical slots. Notably, the size, shape, and dimension of the microstrip patch 100 may be changed (i.e., enlarged) and include additional symmetrical slots.

A plurality of diodes 104A, 104B, 104C, 104D may be coupled to the microstrip patch 100. The plurality of diodes 104A, 104B, 104C, 104D may act as a loading mechanism for the microstrip patch 100, used to control frequency. Specifically, the plurality of diodes 104A, 104B, 104C, 104D may be used to control a center frequency of the microstrip patch 100. In a particular embodiment, each of the plurality of diodes may be identical. In an exemplary embodiment, the plurality of diodes 104A, 104B, 104C, 104D (acting as a loading mechanism) can be varactor diodes, which may be positioned at each corner of the microstrip patch 100. Frequencies of the microstrip patch 100 may reduce as capacitance of the plurality of varactor diodes increases (or the reverse bias voltage of the varactor diodes decreases). The highest resonance frequency may correspond to the minimum reverse capacitance of the varactor diodes (plurality of diodes 104A, 104B, 104C, 104D). Any diode operating at a desired RF frequency may be used as a loading mechanism (e.g., placing four identical varactor diodes at the patch corners—one varactor diode at each respective corner).

Additionally, two asymmetrical feed lines (106A and 106B) may be connected to the microstrip patch 100. In one embodiment, the two asymmetrical feed lines (106A and 106B) may extend outwardly from the microstrip patch 100. In a particular embodiment, the asymmetrical feed lines (106A and 106B) may be conductive, using the same conductive material as the microstrip patch 100. The feed lines (106A and 106B) are referred to as "asymmetrical" due to their difference in location on opposite sides of the microstrip patch 100. This configuration may excite (e.g., generate) multiple frequency modes. In an exemplary embodiment, the asymmetrical feed lines (106A and 106B) extend outwardly from the microstrip patch 100 and have substantially equal sizes and shapes. In alternative embodiments, the asymmetrical feed lines (106A and 106B) may have different shapes and/or different sizes for impedance matching purposes.

Figure 2:
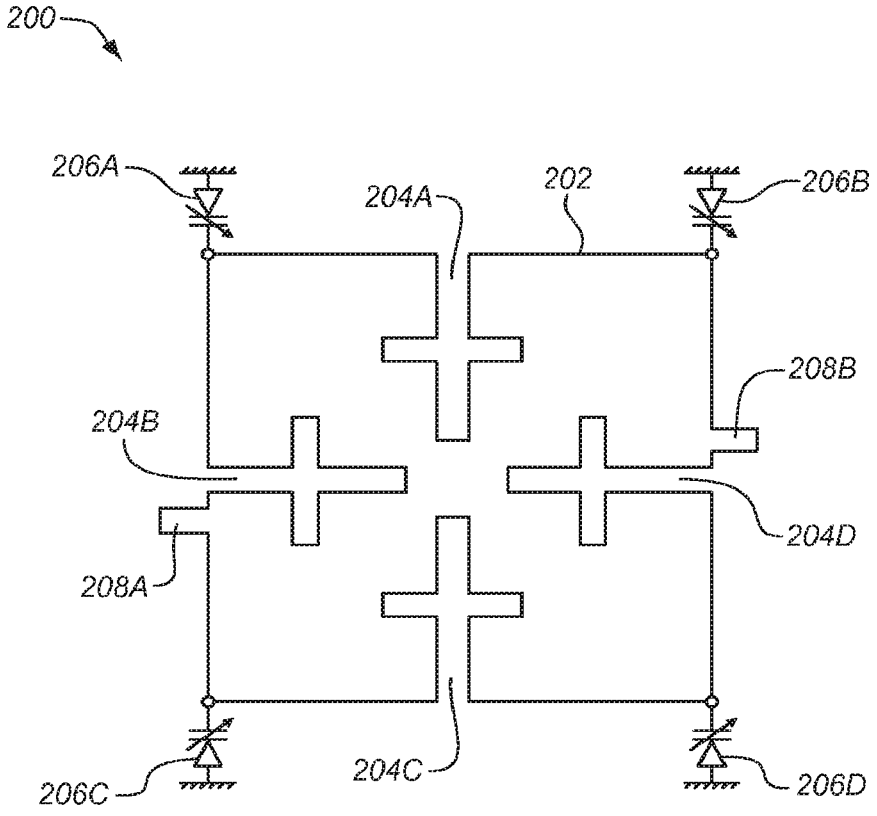
FIG. 2 is an exemplary view of a wide tunable band apparatus, according to an example embodiment.

FIG. 2 is an exemplary view of a wide band filter apparatus, according to an example embodiment. The wide band filter apparatus 200 comprises a square microstrip patch, a plurality of symmetrical slots etched into the square microstrip patch, a plurality of diodes coupled to the square microstrip patch, and two asymmetrical feed lines connected to the square microstrip patch.

The wide band filter apparatus 200 may include a square microstrip patch 202. Similar to FIG. 1, the square microstrip patch 202 may be fabricated out of any conductive material and use print circuit board technology to convey frequency signals. In one embodiment, the square microstrip patch 202 may be a dual-mode microstrip patch capable of operating in both degenerate and higher order frequency modes.

A plurality of symmetrical slots (204A, 204B, 204C, 204D) may be etched into the square microstrip patch 202. The symmetrical slots (204A, 204B, 204C, 204D) etched into the square microstrip patch 202 may be used to control frequency band width through the square microstrip patch 202. In an exemplary embodiment, each of the plurality of symmetrical slots (204A, 204B, 204C, 204D) may be in the design of a cross. In another embodiment, each of the plurality of symmetrical slots (204A, 204B, 204C, 204D) may be rectangular in shape. Notably, the size, shape, and dimension of the square microstrip patch 202 may be changed (i.e., enlarged) and include additional symmetrical slots.

Furthermore, a plurality of diodes (206A, 206B, 206C, 206D) may be coupled to the square microstrip patch 202 in a configuration in which the plurality of diodes (206A, 206B, 206C, 206D) may be positioned at each corner of the square microstrip patch 202. The plurality of diodes (206A, 206B, 206C, 206D) may act as a loading mechanism for the square microstrip patch 202, used to control frequency. Specifically, the plurality of diodes (206A, 206B, 206C, 206D) may be used to control a center frequency of the square microstrip patch 202. In a particular embodiment, each of the plurality of diodes may be identical. In an exemplary embodiment, the plurality of diodes (206A, 206B, 206C, 206D) (acting as a loading mechanism) can be varactor diodes.

Additionally, two asymmetrical feed lines (208A and 208B) may be connected to the square microstrip patch 202. In one embodiment, the two asymmetrical feed lines (208A and 208B) may extend outwardly from the square microstrip patch 202. In a particular embodiment, the asymmetrical feed lines (208A and 208B) may be conductive, using the same conductive material as the square microstrip patch 202. The feed lines (208A and 208B) may be located on opposite sides of the square microstrip patch 202. In an exemplary embodiment, the asymmetrical feed lines (208A and 208B) extend outwardly from the square microstrip patch 202 and have substantially equal sizes and shapes. In alternative embodiments, the asymmetrical feed lines (208A and 208B) may have different shapes and/or different sizes for impedance matching purposes.

Exemplary Methods

In this section, exemplary methods of filtering frequency are described by reference to a flow chart.

Figure 3:
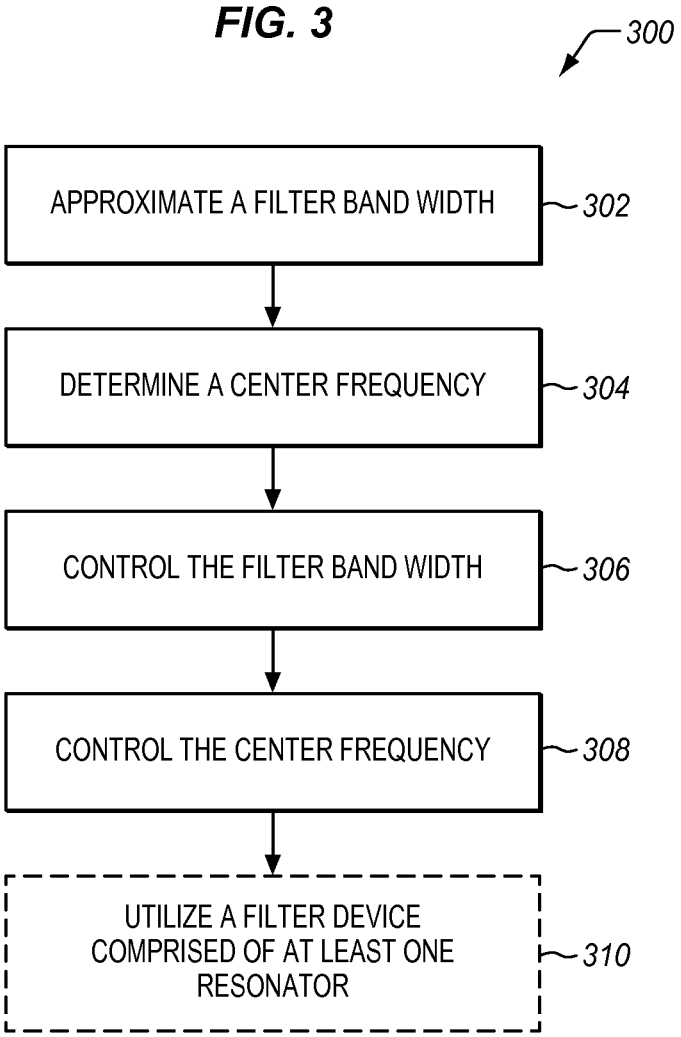
FIG. 3 is a block diagram of a method to filter frequency, according to an example embodiment.

FIG. 3 is a block diagram illustrating a method to filter frequency, according to an example embodiment. The method 300 may be implemented by approximating a filter bandwidth (block 302), determining a center frequency (block 304), controlling the filter bandwidth (block 306), and controlling the center frequency (block 308).

A filter bandwidth is approximated at block 302. The filter band width may be approximated by calculating a difference between at least two frequencies (i.e., "f1" and "f2"). The difference between the at least two frequencies may be calculated using mathematical equations. Devices, which may perform computations, may be used to calculate the filter bandwidth. In one embodiment, the difference between the at least two frequencies may be calculated on a device using a processor. Electrical devices may be used to capture frequency readings (i.e., a resonator). In an exemplary embodiment, the at least two frequencies may be different. Subtracting one frequency from another may approximate the bandwidth.

A filter device such as a dual-mode wide band filter may be used to filter bandwidth. The filter device may include a plurality of resonators. Filter behavior may be achieved through the excitation of two types of modes: degenerate frequency modes and higher order frequency modes. The degenerate mode frequencies do not split and may maintain the same resonance frequencies. Higher order mode frequencies may have higher resonance frequencies than that of degenerate modes.

A center frequency is determined at block 304. The filter center frequency fc may be determined (at block 304) by calculating a geometric mean of the at least two frequencies. The filter center frequency may be approximately defined as the geometric mean of a first frequency ("f1") and a second frequency ("f2"). The equation for calculating the geometric mean of the at least two frequencies may be:

$$(\sqrt{f1f2}).$$

The filter bandwidth is controlled at block 306. In one embodiment, the filter bandwidth may be controlled (block 306) by a plurality of slots etched into the filter device. Slots etched into the filter device may be positioned in different arrangements and have different sizes to impact the filter bandwidth. In an exemplary embodiment, the filter device may be a filter apparatus having etched slots, such as the filter apparatuses described in FIGS. 1 and 2. In one embodiment, the slots etched into the filter device may be symmetric.

The center frequency fc is controlled at block 308. The center frequency may be controlled (block 308) by adjusting resonance frequencies of the at least two frequencies. A loading mechanism may be coupled to the filter device to control the center frequency. The loading mechanism may be any device or apparatus, which may be used to control the center frequency. In one embodiment, the loading mechanism is a plurality of diodes coupled to the filtering device. Each of the plurality of diodes may be identical. In an exemplary embodiment, the plurality of diodes may be varactor diodes, which are positioned at each corner of the filter device. The frequencies of the at least two frequencies may reduce as capacitance of the plurality of varactor diodes increases (or the reverse bias voltage of the varactor diodes decreases). Therefore, adjusting the modes resonance frequencies f1 and f2 can easily control the center frequency. Resonance frequencies f1 and f2 represent the resonance frequencies of the degenerate modes and the first higher order mode, respectively. These resonance frequencies can be calculated, using any electromagnetic simulator such as an electromagnetic full wave simulator. Resonance frequencies f1 and f2 reduce as the slots lengths increase and f2 decreases faster than f1. In other words, f1 and f2 reduce as the capacitance of the varactor diode increases, or as the reverse bias voltage of the varactor diodes decrease. The highest resonance frequency may correspond to the minimum reverse capacitance of the varactor diodes. Any varactor diode operating at a desired RF frequency may be used as a loading mechanism.

An alternative embodiment of FIG. 3 further includes utilizing a filter device comprised of at least one resonator (block 310). A resonator may be any device or system, which exhibits resonance or resonance behavior. In an exemplary embodiment, the at least one resonator may be a mechanical resonator used in an electronic circuit to generate precise frequency signals. In one embodiment, the filter device may be a single dual-mode resonator (equivalent to two single mode resonators). In an alternate embodiment, the filter device may be a two dual-mode resonator (equivalent to four single mode resonators).

Exemplary Implementations

Various examples and embodiments of the present disclosure have been described above. Listed and explained below is experimental documentation representing specific applications of the wide band filter apparatuses.

In a particular embodiment, the wide band filter (such as the wide band filter apparatuses described above) may be a DUROID® brand substrate. DUROID® brand substrates are manufactured by Rogers Corporation of Rogers, Conn. In one embodiment, micro strip patch may be a thin conducting layer having a thickness of approximately 20 micrometers. In one example embodiment, a varactor diode, model number GVD30452 produced by Sprague-Goodman Electronics Inc. may be used. In experimental results, the varactor diodes' capacitance changes approximately from eleven-point-nine (11.9) picofarads ("pF") to one (1) pF as the bias voltage is varies from 0 to 20 volts ("v").

Figure 4:
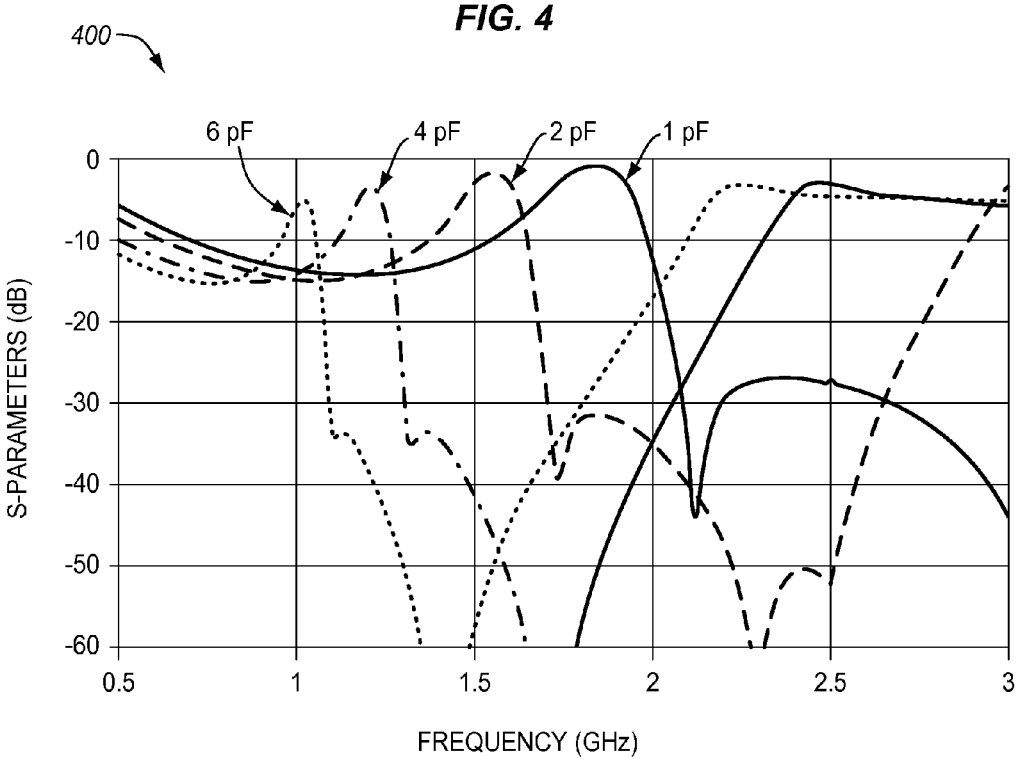
FIG. 4 is a graphical representation of a transmission coefficient (S21) of a filter, according to an example embodiment.

FIG. 4 is a graphical representation of a transmission coefficient (S21) of a filter, according to an example embodiment. The transmission coefficient of a filter may describe the filter insertion loss in the filter passband and filter rejection in the filter stop band. Graph 400 illustrates the change in frequency in GHz of the filter transmission coefficient (i.e. S-Parameter in dB) as the capacitance changes. More specifically, graph 400 demonstrates an example simulated filter transmission coefficient ("S21") for capacitance change of a varactor diode from one (1) pF to two (2) pF to four (4) pF to six (6) pF. The S21 results shown in graph 400 are for wide tunable dual-mode filter(s) designed on a DUROID® brand substrate with a dielectric constant of two-point-two (2.2) and a thickness of point-seven-eight (0.78) millimeters (mm). In the passband, the insertion loss should be very small (ideally, S21 equals zero ("0") decibels ("dB"). In the stop band, the insertion loss should be very high (ideally, S21 should be very small (less than approximately negative twenty (−20) dB. This representation may be useful in identifying components, which may be used in the wide band filter apparatus.

Figure 5:
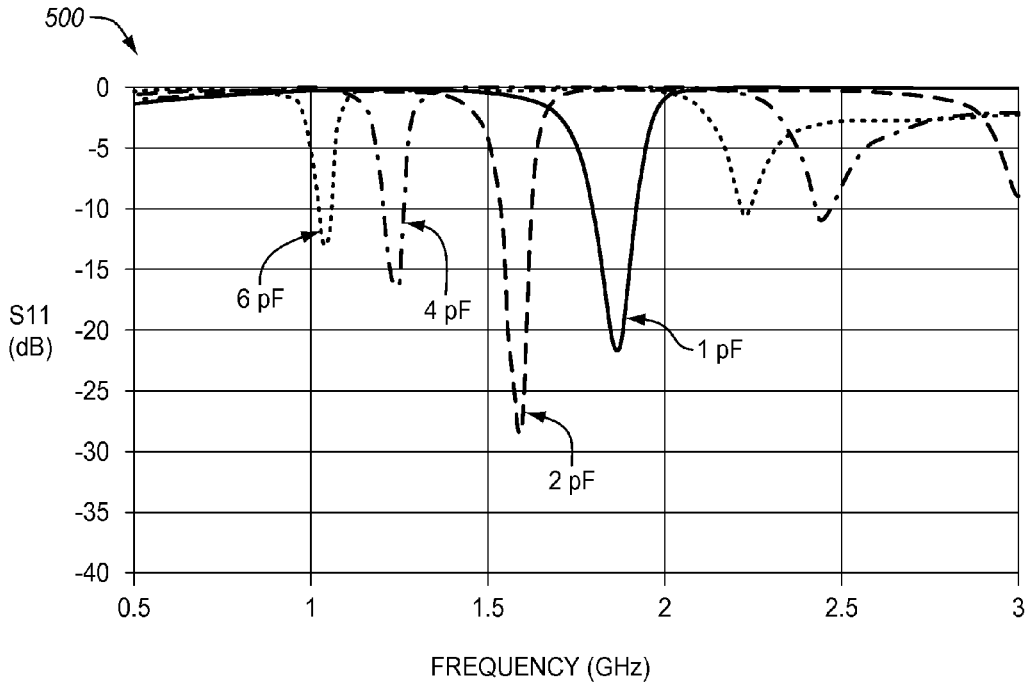
FIG. 5 is a graphical representation of a filter reflection coefficient (S11), according to an example embodiment.

FIG. 5 is a graphical representation of a filter reflection coefficient, according to an example embodiment. The filter reflection coefficient may describe the amplitude or the intensity of a reflected wave relative to an incident wave. Graph 500 illustrates the change in frequency in GHz of the filter reflection coefficient (i.e. S11 in dB) as the capacitance changes. More specifically, block graph 500 demonstrates an example simulated filter reflection coefficient ("S11") for capacitance change of a varactor diode from 1 picofarads ("pF") to 2 pF to 4 pF to 6 pF. The S11 results shown in graph 500 are for tunable dual-mode filter designed on a DUROID® brand substrate with a dielectric constant of two-point-two (2.2) and a thickness of point-seven-eight (0.78) millimeters (mm). In the passband, the reflection coefficient should be very small (ideally, S11 should be less than negative ten (−10) dB). This representation may be useful in identifying components, which may be used in the wide band filter apparatus.

CONCLUSION

This has been a detailed description of some exemplary embodiments of the present disclosure contained within the disclosed subject matter. The detailed description refers to the accompanying drawings that form a part hereof and which show by way of illustration, but not of limitation, some specific embodiments of the present disclosure, including a preferred embodiment. These embodiments are described in sufficient detail to enable those of ordinary skill in the art to understand and implement the present disclosure. Other embodiments may be utilized and changes may be made without departing from the scope of the present disclosure. Thus, although specific embodiments have been illustrated and described herein, any arrangement calculated to achieve the same purpose may be substituted for the specific embodiments shown. This disclosure is intended to cover any and all adaptations or variations of various embodiments. Combinations of the above embodiments, and other embodiments not specifically described herein, will be apparent to those of skill in the art upon reviewing the above description.

In the foregoing Detailed Description, various features are grouped together in a single embodiment for the purpose of streamlining the disclosure. This method of disclosure is not to be interpreted as reflecting an intention that the claimed embodiments require more features than are expressly recited in each claim. Rather, as the following claims reflect, the present disclosure lies in less than all features of a single disclosed embodiment. Thus, the following claims are hereby incorporated into the Detailed Description, with each claim standing on its own as a separate preferred embodiment. It will be readily understood to those skilled in the art that various other changes in the details, material, and arrangements of the parts and method stages which have been described and illustrated in order to explain the nature of this disclosure may be made without departing from the principles and scope as expressed in the subjoined claims.

It is emphasized that the Abstract is provided to comply with 37 C.F.R. §1.72(b) requiring an Abstract that will allow the reader to quickly ascertain the nature and gist of the technical disclosure. It is submitted with the understanding that it will not be used to interpret or limit the scope or meaning of the claims.

What is claimed is:

1. A filter apparatus comprising:

a microstrip patch having a plurality of symmetrical slots etched into the microstrip patch;

a plurality of diodes coupled to the microstrip patch;

two asymmetrical feed lines connected to the microstrip patch, wherein the microstrip patch is in the shape of a square, wherein the plurality of diodes are varactor diodes, and wherein the varactor diodes include four varactor diodes that are positioned at the four corners of the square microstrip patch.

2. The filter apparatus of claim 1, wherein the microstrip patch is a dual-mode microstrip patch capable of operating in both degenerate and higher order frequency modes.

3. The filter apparatus of claim 1, wherein each of the plurality of symmetrical slots etched into the microstrip patch is rectangular in shape.

4. The filter apparatus of claim 1, wherein each of the plurality symmetrical slots etched into the microstrip patch is in the design of a cross.

5. The filter apparatus of claim 1, wherein frequency bandwidth is controlled throughout the microstrip patch by the symmetrical slots etched into the microstrip patch.

6. The filter apparatus of claim 1, wherein the plurality of diodes coupled to the microstrip patch act as a loading mechanism to control resonance frequency.

7. A filter apparatus comprising:

a microstrip patch having a plurality of symmetrical slots etched into the microstrip patch;

a plurality of diodes coupled to the microstrip patch; and two asymmetrical feed lines connected to the microstrip patch, wherein the two asymmetrical feed lines are positioned at opposite sides of the microstrip patch.

8. The filter apparatus of claim 7, wherein the plurality of diodes coupled to the microstrip patch act as a loading mechanism to control resonance frequency.

9. The filter apparatus of claim 7, wherein frequency bandwidth is controlled throughout the microstrip patch by the symmetrical slots etched into the microstrip patch.

10. The filter apparatus of claim 7, wherein each of the plurality symmetrical slots etched into the microstrip patch is in the design of a cross.

11. The filter apparatus of claim 7, wherein the microstrip patch is a dual-mode microstrip patch capable of operating in both degenerate and higher order frequency modes.

12. The filter apparatus of claim 7, wherein the microstrip patch is in the shape of a square.

13. The filter apparatus of claim 7, wherein the plurality of diodes are varactor diodes.

14. The filter apparatus of claim 7, wherein each of the plurality of symmetrical slots etched into the microstrip patch is rectangular in shape.

15. A wide band filter apparatus comprising:

a square microstrip patch;

a plurality of symmetrical slots etched into the square microstrip patch;

a plurality of diodes coupled to the square microstrip patch, wherein the plurality of diodes are respectively positioned at each corner of the square microstrip patch; and two asymmetrical feed lines connected to the square microstrip patch.

16. The apparatus of claim 15, wherein each of the plurality of symmetrical slots etched into the square microstrip patch is in the design of a cross.

17. The apparatus of claim 15, wherein the two asymmetrical feed lines are positioned at opposite sides of the square microstrip patch.

18. The apparatus of claim 15, further comprising a loading mechanism coupled to the filter apparatus.

19. The apparatus of claim 15, wherein the plurality of diodes are varactor diodes.

20. The apparatus of claim 15, wherein each of the plurality of symmetrical slots etched into the square microstrip patch is rectangular in shape.

* * * * *